US007032909B2

(12) United States Patent
Lensing

(10) Patent No.: US 7,032,909 B2
(45) Date of Patent: Apr. 25, 2006

(54) MECHANIC'S CREEPER

(76) Inventor: Jerry P. Lensing, 517 S. 28th St., Van Buren, AR (US) 72956

( * ) Notice: Subject to any disclaimer, the term of this patent is extended or adjusted under 35 U.S.C. 154(b) by 0 days.

(21) Appl. No.: 10/761,471

(22) Filed: Jan. 22, 2004

(65) Prior Publication Data

US 2005/0161894 A1 Jul. 28, 2005

(51) Int. Cl.
*B25H 5/00* (2006.01)

(52) U.S. Cl. ..... 280/32.6

(58) Field of Classification Search ..... 280/32.6, 280/32.7, 79.11, 43.24, 43.25; 188/5, 6, 188/7, 8; 254/418, 422
See application file for complete search history.

(56) References Cited

U.S. PATENT DOCUMENTS

| | | | | | |
|---|---|---|---|---|---|
| 2,780,472 | A | * | 2/1957 | Weldon, Sr. | 280/32.6 |
| 2,879,865 | A | * | 3/1959 | Simmons | 188/69 |
| 2,942,693 | A | * | 6/1960 | Johnson | 188/5 |
| 3,361,437 | A | * | 1/1968 | Loftis | 280/32.6 |
| 3,984,116 | A | * | 10/1976 | Bowers | 280/32.6 |
| 4,244,594 | A | * | 1/1981 | Hines | 280/32.6 |
| 4,815,569 | A | * | 3/1989 | Norman | 188/5 |
| 5,108,118 | A | | 4/1992 | Schaevitz | |
| 5,249,823 | A | | 10/1993 | McCoy et al. | |
| 5,472,219 | A | * | 12/1995 | Eckstrum | 280/32.6 |
| D367,140 | S | | 2/1996 | Reese | |
| D371,450 | S | | 7/1996 | Hodges | |
| 5,611,552 | A | * | 3/1997 | Miles et al. | 280/32.6 |
| 5,730,449 | A | | 3/1998 | Miles | |
| D398,433 | S | | 9/1998 | Whiteside et al. | |
| 5,857,683 | A | * | 1/1999 | Auel | 280/32.6 |
| 5,863,053 | A | | 1/1999 | Berry | |
| 5,897,122 | A | * | 4/1999 | Borner | 280/32.6 |
| 6,076,838 | A | * | 6/2000 | Peterson et al. | 280/32.6 |
| 6,095,532 | A | * | 8/2000 | Martin | 280/32.6 |
| D444,282 | S | | 6/2001 | Lensing et al. | |
| 2004/0227913 | A1 | * | 11/2004 | Shockley | 280/32.6 |
| 2005/0023780 | A1 | * | 2/2005 | Liu | 280/32.6 |

* cited by examiner

*Primary Examiner*—J. Allen Shriver
(74) *Attorney, Agent, or Firm*—Boyd D. Cox

(57) ABSTRACT

The present invention is a wheeled creeper having a braking device that releasably engages the support surface in order to deter the creeper from rolling freely on the surface. The braking device includes brake shoes and a handle that is readily accessible for engaging and disengaging the brake shoes. In addition, the wheeled creeper can be disassembled for shipping and storage.

16 Claims, 5 Drawing Sheets

MECHANIC'S CREEPER

BACKGROUND

The present invention is directed to a wheeled creeper of the type used by mechanics working in a prone position underneath motor vehicles and other heavy equipment. More particularly, this invention is directed to a wheeled creeper having a brake means for releasably engaging the support surface and that can be selectively engaged to inhibit movement of the creeper. Furthermore, the present invention can be readily disassembled to effect a more compact form for storing and transporting.

Mechanics are often required to work in confined areas that are difficult to access, such as beneath a motor vehicle or under other heavy equipment where space is limited. One option when working in such a confined area is to lie recumbent on the floor or ground and slide beneath the vehicle. Maneuvering in a small space is difficult and frustrating and can increase the time required to perform a requisite task. Furthermore, lying directly on and sliding over a hard, abrasive surface is not only uncomfortable, it can also result in injuries. Once under the vehicle, mobility is more limited and it is even more difficult to maneuver.

Due to the difficulty of maneuvering into and out of the confined work area, a mechanic is more likely to use an inappropriate tool because it is handy, rather than attempt to retrieve the proper tool at a distant location and out of reach. Consequently, the quality of work can be compromised.

Wheeled creepers comprising a platform supported on casters are known in the art. These enable a user, lying prone on the platform, to easily roll himself into and out of the confined work area beneath a vehicle. While such wheeled creepers can be beneficial, they have several drawbacks. Using a wheeled platform, the profile of the mechanic is higher giving the mechanic less clearance under the vehicle and therefore diminishing maneuverability. It is desirable, therefore, to have a creeper with a low profile to give the user more room to maneuver. Although a lower profile can be created by using smaller casters with smaller wheels, such smaller wheels are less maneuverable when rolling over uneven surfaces or surface obstructions such as concrete seams. The need exists for a wheeled creeper having wheels that can maneuver easily over uneven surfaces and obstructions, yet have a low profile to enable the user to have easy access to confined areas.

While a wheeled creeper can make it easier to get underneath a motor vehicle or heavy equipment, the creeper is free to roll about freely while the mechanic is working. Such movement can be a deterrent to a user attempting to work from the creeper. Generally, a user can use his hands to brace the creeper against movement, but this is impractical when both hands are required for performing a task. Therefore, there is a need for a wheeled creeper having a brake means that is easily reachable for a prone user and that can be readily engaged to deter the creeper from rolling about freely.

A wheeled creeper must be large enough to accommodate the head and torso of a user and strong enough to support most of the user's body weight. However, when storing and/or transporting the creeper, a compact size is an important consideration. Consequently, there is a need for a wheeled creeper large enough to accommodate most users, and that can be disassembled for storing and/or transporting in a more compact form.

The present invention is a mechanic's creeper having brake means for releasably engaging a support surface in order to deter rolling movement of the creeper. The brake means can be easily accessed by the user when lying prone on the platform and readily engaged and disengaged in a confined space. The brake means can be engaged to deter rolling of the creeper along the floor. Conversely, the brake means can be disengaged, thereby releasing the creeper to roll freely when pushed or pulled across a supporting surface. The creeper has large wheels to enable the creeper to move easily across uneven surfaces. The wheels are accommodated by the frame while supporting the platform below the height of the wheels in order to provide a low profile for the creeper. Furthermore, the creeper can be broken down into smaller components to facilitate transporting and storing.

SUMMARY

The present invention is directed to a wheeled creeper for moveably supporting a user in a prone position in order that the user can maneuver into a confined space, such as beneath a motor vehicle or other equipment. The creeper has brake means for releasably engaging the support surface. The brake means can be selectively engaged to deter the creeper from rolling freely on a support surface and disengaged to allow the creeper to roll.

It is an object of the present invention to provide a wheeled creeper having a brake means for releasably engaging a support surface to hold the creeper steady.

It is a further object of the present invention to provide a low profile, wheeled creeper having casters that extend above the height of the platform.

It is a further object of the present invention to provide a creeper that can be readily disassembled for shipping or storage and assembled for use.

It is a further object of the present invention to provide a wheeled creeper with a braking device that frictionally engages a support surface in order to inhibit rolling.

It is a further object of the present invention to provide a wheeled creeper with a braking device that frictionally engages a plurality of locations on a support surface to deter rolling of the creeper.

It is a further object of the present invention to provide a braking device that can be readily accessed by a user lying prone on the wheeled creeper.

It is a further object of the present invention to provide a braking device that can be easily engaged and disengaged by a user lying prone on the wheeled creeper.

It is a further object of the present invention to provide a wheeled creeper having brake shoes on the forward and rearward ends of the creeper.

BRIEF DESCRIPTION OF DRAWINGS

Reference is made to the accompanying drawings in which are shown illustrative embodiments of the invention and from which novel features and advantages will be apparent.

DETAILED DESCRIPTION

Figure 1:
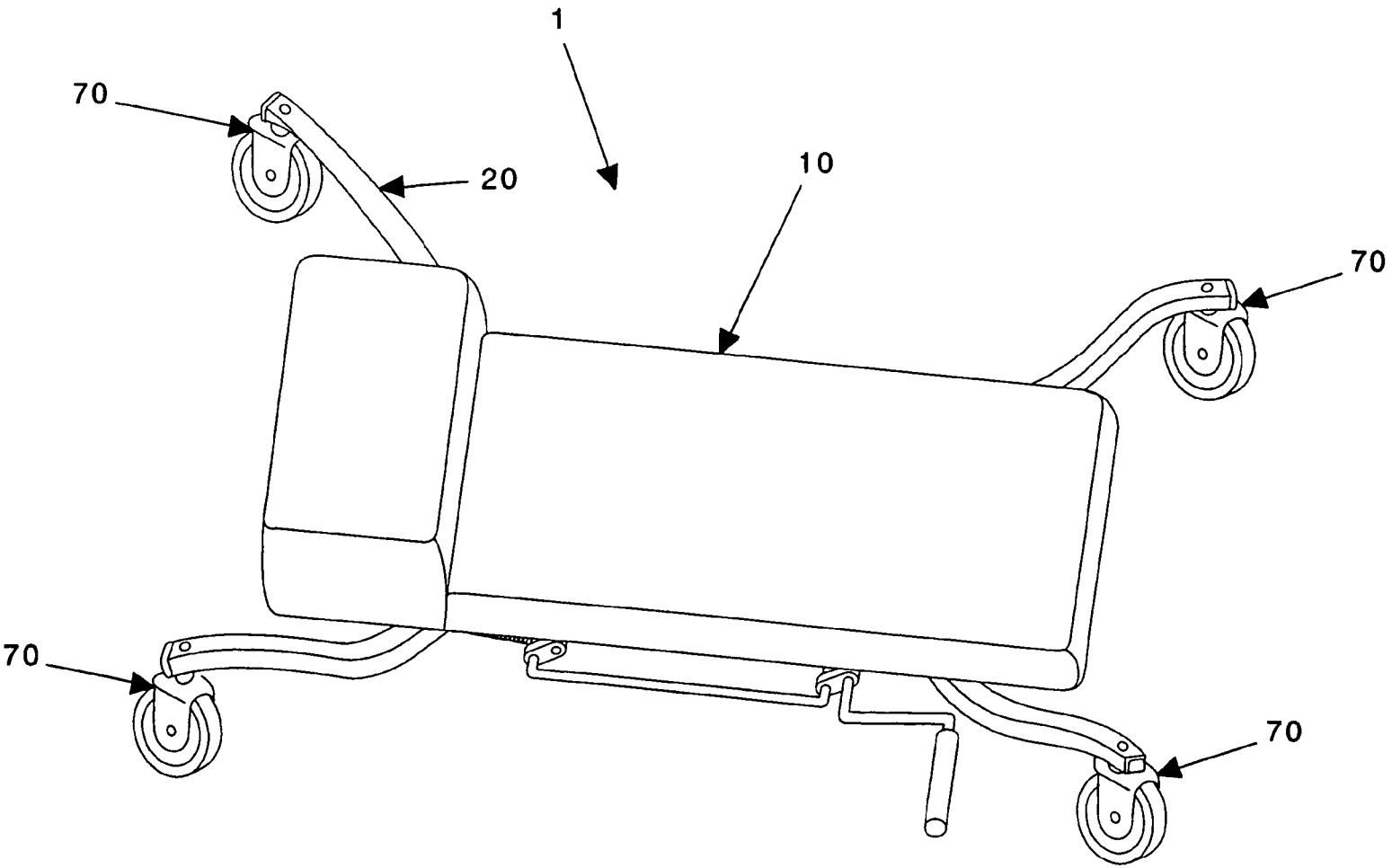
FIG. 1 is a top perspective view of a preferred embodiment of the mechanic's creeper of the present invention.
Figure 2:
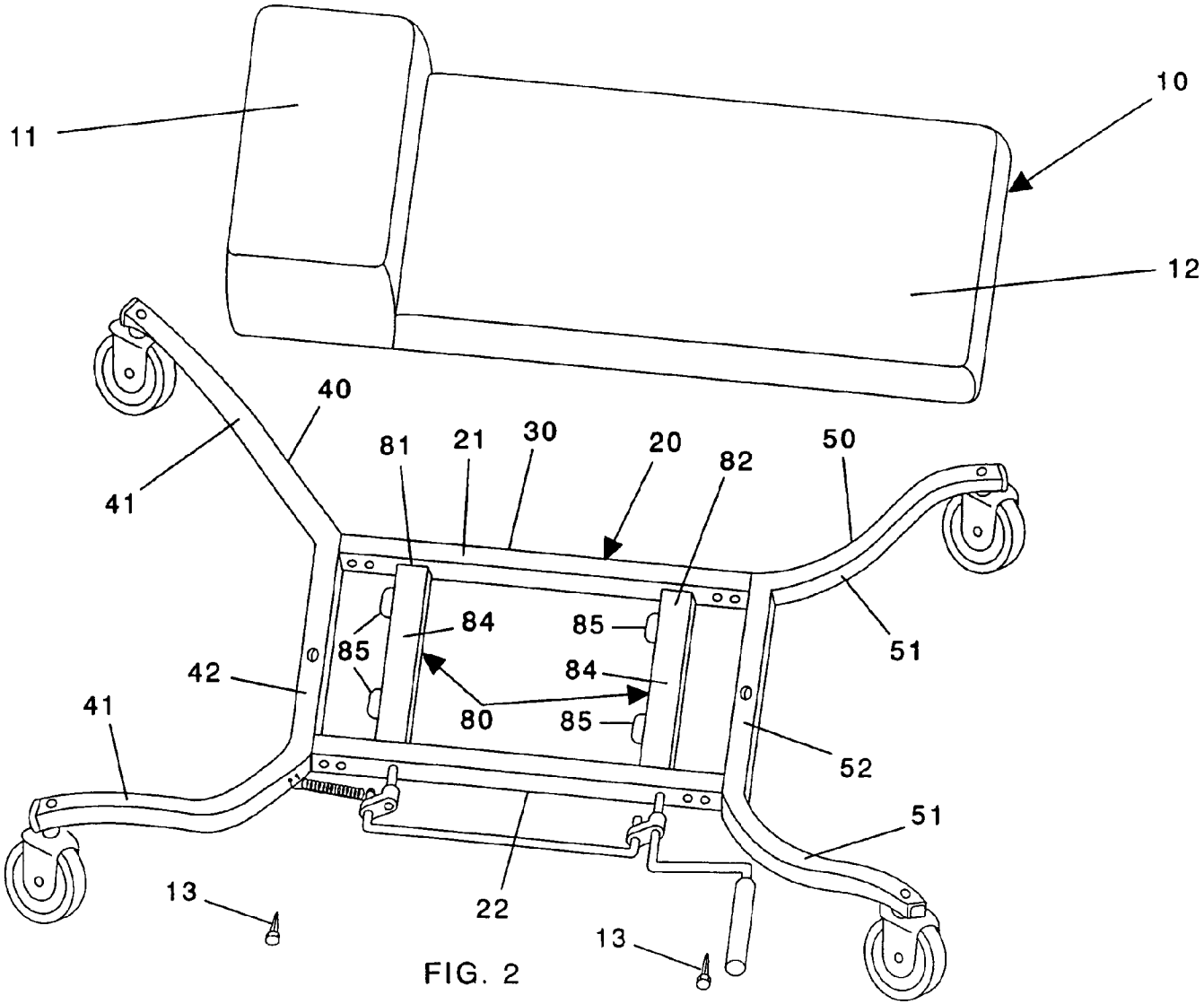
FIG. 2 is a top perspective view of the mechanic's creeper of FIG. 1 with the platform detached showing the braking device in the raised position.

Referring to FIGS. 1 and 2, there is shown a wheeled creeper 1 having a platform 10 and a frame 20 all of which are supported on a plurality of casters 70. The wheeled creeper 1 further includes a brake means for releasably engaging the support surface on which the creeper 1 is positioned and means for releasably connecting the portions.

Figure 3:
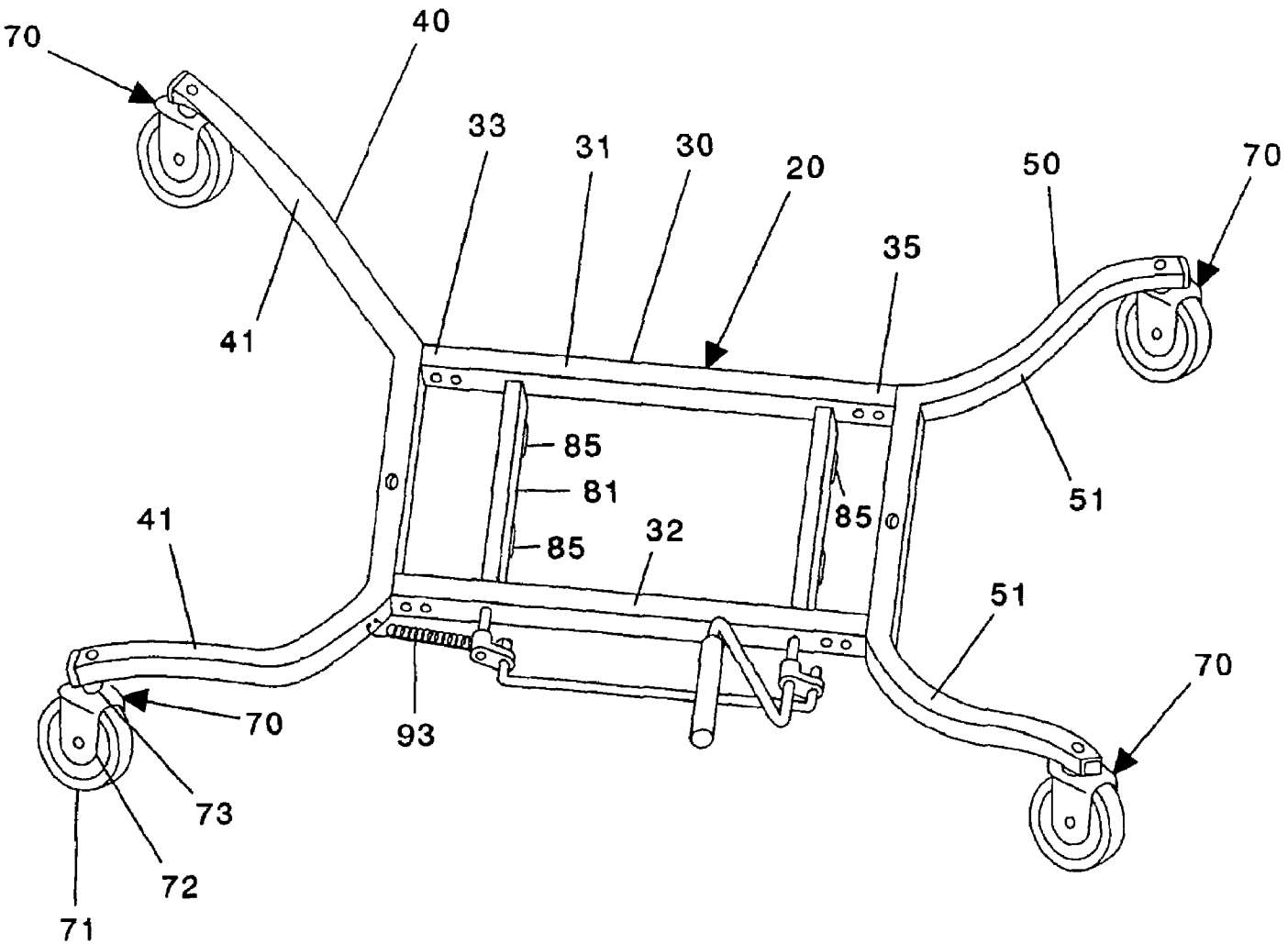
FIG. 3 is a top perspective view of the mechanic's creeper of FIG. 1 with the platform removed, showing the braking device in the lowered position.
Figure 4:
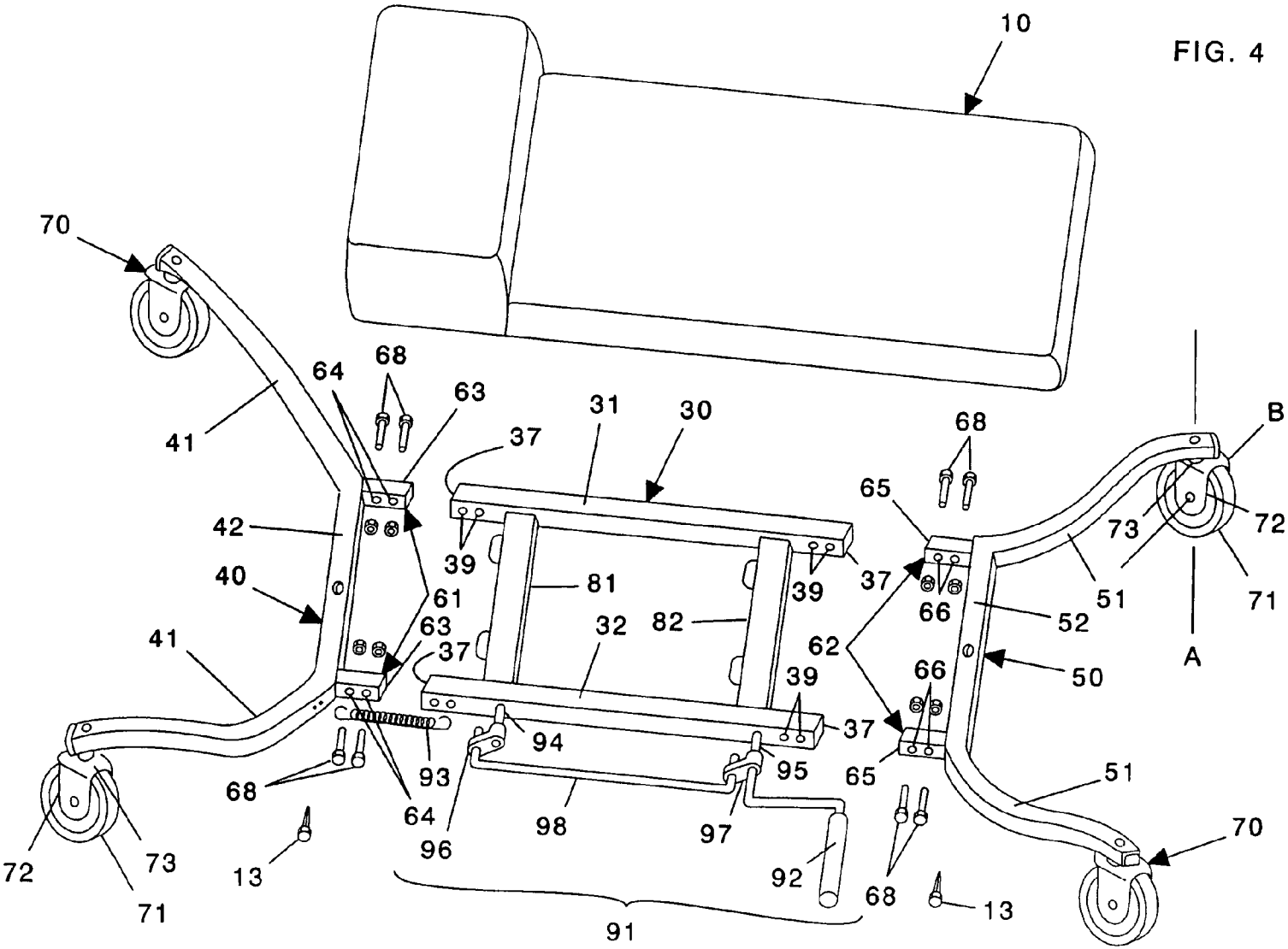
FIG. 4 is a top perspective view of the mechanic's creeper of FIG. 1 having the platform detached and the frame disassembled.

The frame 20 has an upper side 21 and a lower side 22. It also includes a central portion 30 flanked by first 40 and second 50 portions. Referring to FIGS. 3 and 4, the central portion 30 includes first 31 and second 32 struts which are spaced apart and extend parallel to each other.

The central portion 30 has a pair of ends, namely first 33 and second 35 ends. Each of the first 33 and second 35 ends of the central portion has a pair of sockets 37. A socket 37 is located on each of the distal ends of the first 31 and second 32 struts. A plurality of end apertures 39 are disposed on the distal ends of each first 31 and second 32 strut and extend through a respective socket 37.

Each of the first 40 and second 50 portions of the frame 20 includes a pair of legs 41, 51 and a crosspiece 42, 52. On each first 40 and second 50 portion, the legs 41, 51 are attached by their proximal ends to the respective crosspiece 42, 52, thereby giving each portion 40, 50 a generally U-shape. Each of the distal ends of the legs 41, 51 are supported on a swivelable caster 70.

The means for releasably connecting the portions attaches the first 40 and second 50 portions to the central portion 30 of the frame 20. It comprises first 61 and second 62 connecting members. The first connecting member 61 comprises a pair of studs 63. Each of the studs 63 of the first connecting member 61 includes a pair of through holes 64. The first connecting member 61 also includes the sockets 37 and end apertures 39 on the first end of the central portion 30.

Similarly, the second connecting member 62 comprises a pair of studs 65 with each stud 65 having a pair of through holes 66. It also includes the sockets 37 and end apertures 39 on the second end 35 of the central portion 30.

The casters 70 are swivelable and each includes a wheel 71, a wheel mounting bracket 72 and a pivot bearing 73. Each wheel 71 is rotatably mounted on a wheel mounting bracket 72. The wheel mounting bracket 72 is secured by a pivot bearing 73 to the distal end of a respective leg 41, 51 so that the casters 70 can freely swivel about an axis A extending vertically to the wheel's axle B.

Referring to FIG. 2, the platform 10 includes first 11 and second 12 sections. The sections 11, 12 of the platform 10 are cushioned by padding for a user's comfort. The first section 11 which is adapted to support the head of a user lying prone on the platform 10 is thicker than the second section 12 which is adapted to support the user's torso.

The brake means for releasably engaging the support surface comprises a braking device 80. The braking device 80 includes a plurality of brake shoes and actuating means for moving the brake shoes into and out of engagement with the support surface. The plurality of brake shoes includes first 81 and second 82 brake shoes. Each brake shoe 81, 82 is preferably formed by an elongated member 84 with a pair of brake pads 85 disposed along one surface thereof.

The actuating means for moving the brake shoes is a linkage 91 comprising first 94 and second 95 mounting rods and a tie rod 98 as shown in FIG. 4. The first mounting rod 94 has a first lever 96 fixedly attached thereto and rotates with the first mounting rod 94. Similarly, a second lever 97 is fixedly mounted on the second mounting rod 95 and the two rotate together when the linkage 91 is activated. The tie rod 98 extends between the first 96 and second 97 levers. The linkage 91 further includes a handle 92 and a biasing means for holding the brake means in a disengaged position. The biasing means comprises a coil spring 93 in the illustrated preferred embodiment, although other biasing elements such as an elastic band could be used instead.

Figure 5:
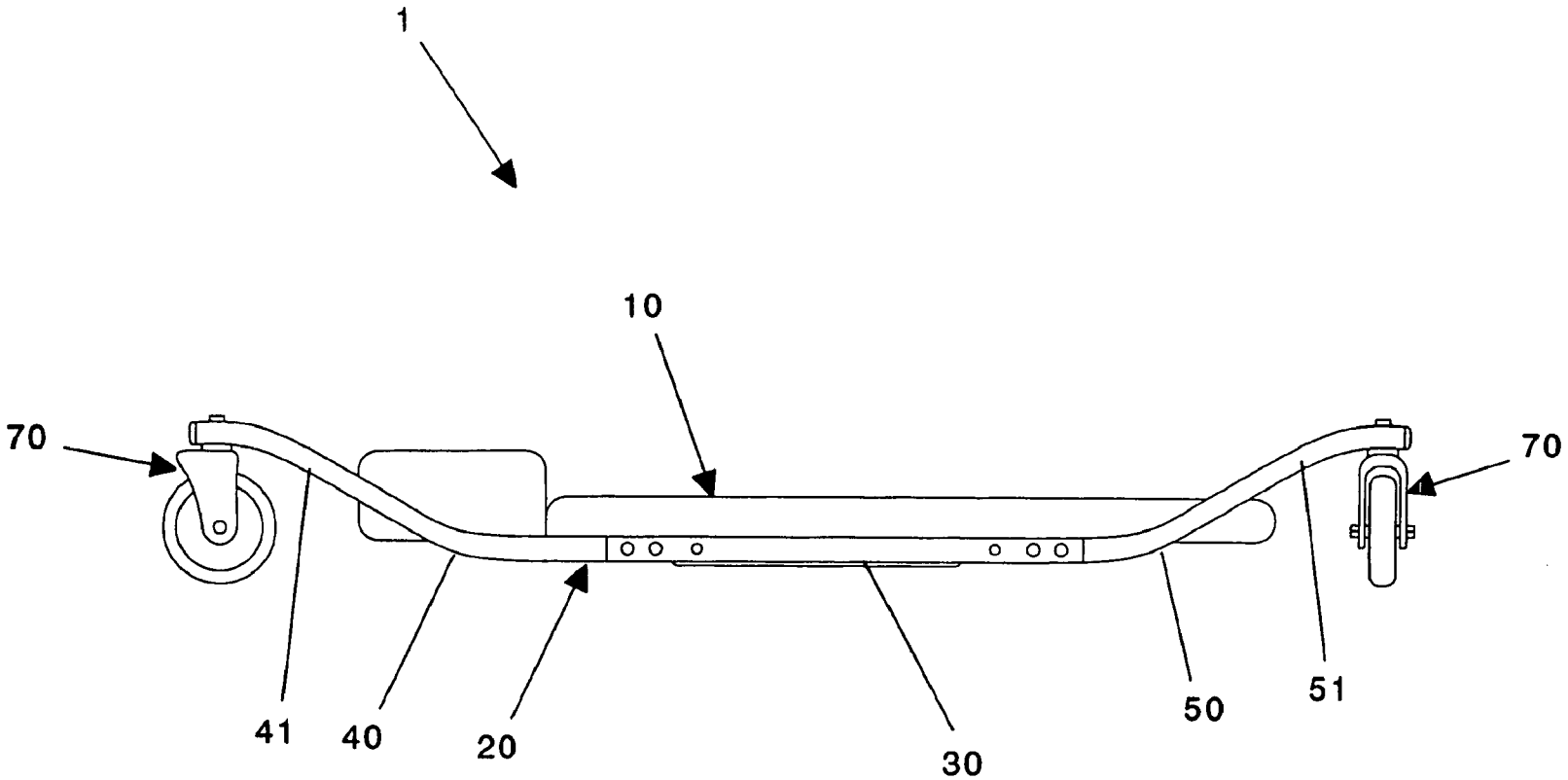
FIG. 5 is a side view of the mechanic's creeper of FIG. 1.

The first 40, second 50 and central 30 portions of the frame 20 are preferably tubular in cross section. Each of the tubular-shaped legs 41, 51 of the frame 20 is curvilinear along its length, as shown in FIG. 5. The proximal ends of each leg 41, 51 is attached to the respective crosspiece 42,52 and the distal ends are each attached to a caster 70. With their curvilinear shape, the legs 41, 51 can accommodate the differences in the height of the casters 70 at their distal ends and the height of the platform 10 at their proximal ends. The proximal ends are lower and therefore closer to the support surface than the distal ends so that the central portion 30 of the frame 20 and platform 10 are suspended above the supporting surface and below the top of the casters 70. This arrangement lends a lower profile to the creeper 1 so that a user lying prone on the platform 10 can more easily fit into a confined space.

In the preferred embodiment of FIG. 4, the legs 41, 51, struts 31, 32 and crosspieces 42, 52 of the frame 20 are comprised of steel tubing. However, other suitable structural members such as angle beams and I-beams could be used in lieu of the tubing. In addition, other materials could be substituted for the steel, such as aluminum, plastic or composites.

On the central portion 30 of the frame 20, the first 61 and second 62 connecting members releasably secure the first 40 and second 50 portions, respectively, to opposite ends of the central portion 30. Consequently, the frame 20 can be broken down into smaller components for storing and/or transporting. By detaching the platform 10 and coil spring 93 from the frame 20, releasing the first 61 and second 62 connecting members, and separating the first 40 and second 50 portions from the central portion 30, the frame 20 can be disassembled.

The platform 10 is attached to the frame 20 by fasteners such that the bottom surface of the platform 10 is adjacent to the upper side 21 of the frame 20, as shown in FIG. 2. The fasteners comprise a plurality of frame attaching screws 13 that extend through the frame 20 and engage a bottom surface of the platform 10 to secure the platform 10 onto the frame 20 when the creeper is assembled. When assembled, the platform 10 overlays the central portion 30 and parts of the first 40 and second 50 portions. Furthermore, the platform 10 extends between the upwardly curving legs 41, 51 of the first 40 and second 50 portions.

Referring to FIG. 4, the first 40 and second 50 portions of the frame 20 are releasably adjoined to the central portion 30 by the connecting members 61, 62. The first connecting member 61 releasably attaches the first portion 40 to the first end 33 of the central portion 30. The second portion 50 is attached by the second connecting member 62 to the second end 35 of the central portion 30 and is opposite the first portion 40.

Each of the crosspieces 42, 52 of the first 40 and second 50 portions has two ends, each of which are attached to the proximal ends of the respective legs 41, 51. The studs 63 of the first connecting member 61 are mounted on the crosspiece 42 of the first portion 40. Similarly, the studs 65 of the second connecting member 62 are mounted on the crosspiece 52 of the second portion 50.

When the creeper 1 is assembled the studs 63 of the first portion 40 are positioned respectively within the sockets 37 on the first end of the central portion 30. The studs 65 on the second portion 50 are disposed within the sockets 37 on the second end 35 of the central portion 30. With the studs 63, 65 so located, the end apertures 39 on each of the first 31 and second 32 struts are aligned with the respective through holes 64, 66 in the inserted stud 63, 65 and a pin 68 extends through each of the respective aligned sets of end apertures 39 and through holes 64, 66.

The creeper 1 comprises an assembled and a disassembled configuration. As shown in FIGS. 1 and 2, the first 40 and second 50 portions of the assembled frame 20 are attached to the central portion 30 and the platform 10 is connected to the frame 20 in the assembled configuration.

In the disassembled configuration of FIG. 4, the platform 10 is detached from the frame 20, the coil spring 93 is detached from the frame, and the first 40 and second 50 portions are detached from the central portion 30.

To detach the platform 10 from the frame 20, the attaching screws 13 are withdrawn and the platform 10 is lifted from the frame 20. The first 61 and second 62 connecting members are disconnected by removing the pins 68 from the ends of both struts 31, 32 and pulling the respective first 40 and second 50 portions away from the central portion 30 to thereby remove the studs 63, 65 from the respective sockets 37.

The central portion 30 of the frame 20 is flanked by the first portion 40 on its first end 33 and by the second portion 50 on its second end 35. The legs 41, 51 of each portion 40, 50 extend upwardly and outwardly from their respective crosspieces 42, 52. With the creeper 1 resting on a support surface, the distal ends of the legs 41, 51 are positioned farther above the support surface than the proximal ends. Consequently, the platform 20 is lower and therefore nearer to the support surface than the tops of the casters 70.

The braking device 80 includes engaged and disengaged positions. The brake shoes 81, 82 are raised and lowered to define the disengaged and engaged positions, respectively. In response to the actuating means, the first 81 and second 82 brake shoes move together and therefore generally maintain the same orientation with respect to the frame 20.

When lowered in the engaged position as shown in FIG. 3, the brake shoes 81, 82 extend out and down from the frame 20 so that the brake pads 85 engage the support surface. In this position, movement of the creeper 1 is deterred.

In the disengaged position, the brake shoes 81, 82 are raised to a location adjacent the frame 20 in which the brake pads 85 are lifted up away from the support surface and disengaged therefrom.

The elongated members 84 of the brake shoes 81, 82 and actuating means are preferably made of steel. However, other suitable materials could be used instead, including aluminum and other metals. Alternatively, the elongated members 84 could comprise other materials such as wood or plastic that are suited for such purpose. The brake pads 85 are preferably made of rubber or other resilient, durable materials including nylon and plastic.

The linkage 91 moves the brake shoes 81,82 between the engaged position in FIG. 3 and the disengaged position in FIG. 4. The handle 92 directly rotates the second mounting rod 95. When the second mounting rod 95 is rotated, the second lever 97 rotates also. Rotation of the second lever 97 shifts the tie rod 98 which in turn moves the first lever 96. Movement of the first lever 96 activates rotational movement of the first mounting rod 94. Since the first 81 and second 82 brake shoes are fixedly mounted on the respective first 94 and second 95 mounting rods, the brake shoes 81, 82 pivot with the rotational movement of the mounting rods 94, 95. Consequently, by manipulating the handle 92, a user can move the braking device 80 between the engaged and disengaged positions. The coil spring 93 biases the braking device 80 in the disengaged position.

With the brake pads 85 frictionally engaging the support surface, the creeper 1 is deterred from rolling freely across the support surface. It should be appreciated that when the braking device 80 is engaged, contact between at least one or more of the wheels and the support surface is decreased.

The braking device 80 is supported on the frame 20. The first 94 and second 95 mounting rods are mounted on and extend between the struts 31, 32 of the central portion 30. One end of each of the first 94 and second 95 mounting rods is rotatably mounted on the first strut 31, and the other end of the rods 94, 95 is rotatably mounted on the second strut 32. The first lever 96 is fixedly attached to one end of the first mounting rod 94. The second lever 97 is fixedly attached to one end of the second mounting rod 95. One end of the tie rod 98 is pivotally mounted to the first lever 96 and the opposite end of the tie rod 98 is pivotally mounted to the second lever 97. The handle 92 is fixedly attached to the second mounting rod 95. Both the first 96 and second 97 levers are disposed outside of the frame 20 and are on the same side of the frame 20 as the handle 92.

The first brake shoe 81 is fixedly secured to the first mounting rod 94 and disposed between the first 31 and second 32 struts of the frame 20. Similarly, the second brake shoe 82 is fixedly attached to the second mounting rod 95 and is disposed between the struts 31, 32. A pair of brake pads 85 is mounted on a surface of each of the brake shoes 81, 82.

The coil spring 93 is elongated and is further characterized by having two ends. One end of the coil spring 93 is removably attached to the first portion 40 of the frame 20 proximate the first lever 96. The other end of the spring 93 is attached to the end of the first tie rod 98 that engages the first lever 96.

When the handle 92 is rotated, the second mounting rod 95 and second lever 97 are rotated in unison therewith. As the second lever 97 rotates, the tie rod 98 shifts generally linearly, thereby rotating the first lever 96 and hence the first mounting rod 94. The first 81 and second 82 brake shoes pivot with the rotation of the first 94 and second 95 mounting rods.

The handle 92 is positioned to one side of the frame 20 near an end of the platform 10 adjacent to the second portion 50 and is readily accessible to the outstretched arm of a user lying prone on the platform 10. The accessibility of the handle 92 renders it easy to manipulate when the user is lying on the creeper 1. With the brake shoes 81, 82 mounted between the first 31 and second 32 struts of the central portion 30, the shoes 81, 82 are generally nestled within the frame 20 when withdrawn in the disengaged position.

The creeper 1 is generally used on a support surface, such as a floor or the ground. Preferably, the user lies on the cushioned platform 10 and pushes and/or pulls himself and the creeper 1 into a desired position. Once in position, the braking device 80 is engaged to inhibit rolling of the creeper 1. To change locations, the braking device 80 is disengaged and the user rolls the creeper 1 to another location.

To engage the braking device 80, the handle 92 is rotated in a counterclockwise direction, thereby lowering the brake shoes 81, 82. The handle 92 is rotated until the brake pads 85 are directly beneath the elongated member 84 and in direct engagement with the support surface. In order to move the brake shoes 81, 82 into the engaged position, an initial force great enough to overcome the bias of the coil spring 93 must be applied to the handle 92. It should be noted that this counterclockwise direction of rotation is preferred. However, the braking device 80 could be assembled such that the rotation would be clockwise, if desired.

To disengage the braking device, the handle 92 is rotated clockwise or in a reverse direction to that required to engage the braking device 80 and the respective brake shoes 81, 82 are pivoted away from the supporting surface and into the disengaged position, leaving the creeper 1 free to roll across the support surface.

A preferred device of the present invention is a wheeled creeper with a braking device that can be readily engaged to inhibit unwanted movement of the creeper or disengaged to allow the creeper to roll freely on a support surface. The braking device is readily accessible to a user lying on the creeper and can be easily engaged and disengaged using the handle extending from the side of the frame. With the platform lower than the height of the wheels, the creeper has a low profile yet maintains easy maneuverability on uneven support surfaces due to the height and position of the wheels. Furthermore, the frame can be readily broken down into smaller components to facilitate storing or transporting the creeper.

Although the present invention has been described in considerable detail with reference to certain preferred versions thereof, other versions are possible. Therefore, the spirit and scope of the appended claims should not be limited to the description of the preferred versions contained herein.

What is claimed is:

1. A wheeled creeper for use on a support surface, the wheeled creeper comprising:

a frame;

a platform mounted on said frame;

a plurality of swivelable casters supporting the frame; and a braking device for releasably engaging the support surface;

said braking device comprising a plurality of brake shoes and a linkage for actuating the brake shoes;

said linkage includes a plurality of mounting rods, a plurality of levers, a tie rod and a handle, wherein said tie rod connects said plurality of levers.

2. The wheeled creeper of claim 1, wherein said braking device is movable between an engaged position and a disengaged position;

when said braking device is in said engaged position the creeper is deterred from rolling movement; and when said braking device is in said disengaged position the creeper is free to roll on the support surface.

3. The wheeled creeper of claim 2, wherein said plurality of brake shoes comprises a first and second brake shoe; and said linkage moves the first and second brake shoes between the engaged and disengaged positions.

4. The wheeled creeper of claim 3, wherein said plurality of mounting rods includes first and second mounting rods and said plurality of levers comprises first and second levers.

5. The wheeled creeper of claim 4, wherein said first and second mounting rods are pivotally mounted to the frame; said first lever and said first brake shoe are fixedly mounted on said first mounting rod; said second lever and said second brake shoe are fixedly mounted on said second mounting rod; one end of said tie rod is pivotally mounted on said first lever; and another end of said tie rod is pivotally mounted on said second lever; and said handle is fixedly mounted to said second mounting rod.

6. The wheeled creeper of claim 5, wherein said linkage further comprises a spring having one end attached to the frame and another end attached to said first mounting rod; wherein said spring biases the braking device in the disengaged position.

7. The wheeled creeper of claim 1, wherein each of said brake shoes comprises an elongated member and at least one brake pad disposed on the elongated member.

8. The wheeled creeper of claim 1, wherein said plurality of brake shoes comprises a first and second brake shoe.

9. The wheeled creeper of claim 1, wherein each of said brake shoes includes a brake pad for engaging the support surface;

when said braking device is in said engaged position said at least one brake shoe is lowered with the brake pad directed away from the platform, the brake engages the support surface, and the creeper is deterred from rolling; and when said braking device is in said disengaged position said at least one brake shoe is raised with the brake pad positioned away from the support surface and said creeper is allowed to roll freely.

10. The wheeled creeper of claim 2, wherein said linkage further comprising biasing means for holding the braking device in the disengaged position.

11. A wheeled creeper for use on a support surface, the wheeled creeper comprising:

a frame;

a platform releasably mounted on the frame;

a plurality of swivelable casters supporting the frame; and a braking device for deterring rolling movement of the creeper, wherein said frame comprises a central portion, a first portion and a second portion;

said central portion comprises first and second ends;

said frame further comprises first and second releasable connecting members, wherein said first releasable connecting member attaches the first portion to the first end of the central portion, and said second releasable connecting member attaches said second portion to the second end of the central portion.

12. The wheeled creeper of claim 11, wherein said first connecting member comprises at least one stud on the first portion and a socket on the first end of the central portion which slideably receives the stud on the first portion therein; and said second connecting member comprises at least one stud on the second portion and a socket on the second end of the central portion which slideably receives the stud on the second portion therein.

13. The wheeled creeper of claim 12, wherein said first connecting member further comprises at least one end aperture extending through the socket on the first end of the central portion and at least one through hole in said stud on the first portion and at least one releasable pin; and said second connecting member further comprises at least one end aperture extending through the socket on the second end of the central portion and at least one through hole in said stud on the second portion and at least one releasable pin;

wherein each of said through holes in the at least one stud on the first and second portions is aligned with a respective end aperture on the first and second ends of the central portion, and one of said plurality of releasable pins extends through each aligned through hole and end aperture.

14. The wheeled creeper of claim 12, wherein said at least one stud on each of said first and second portions comprises a pair of studs, and said at least one socket on each of the first and second ends of the central portion comprises a pair of sockets.

15. The wheeled creeper of claim 12, wherein said braking device comprises at least one brake shoe that releasably engages the support surface and an actuating means for moving the at least one brake shoe between an engaged and disengaged position with the support surface.

16. A wheeled creeper for use on a support surface, the wheeled creeper comprising:

a frame;

four swivelable casters supporting the frame;

brake means for releasably engaging the support surface; and a platform mounted on said frame;

said frame comprising central, first and second portions;

said frame further comprising means for releasably connecting the portions;

said central portion comprises first and second struts, said first and second struts extending generally parallel; said central portion having first and second ends;

said first portion comprises a pair of legs and a crosspiece, said legs each having proximal and distal ends, wherein the proximal end of each of said legs is attached to the crosspiece;

said second portion comprises a pair of legs and a crosspiece, said legs each having proximal and distal ends, wherein the proximal end of each of said legs is attached to the crosspiece;

wherein said legs on said first and second crosspieces are curvilinear;

said means for releasably connecting the portions comprises first and second connecting members;

said first connecting member comprises at least one stud extending from the crosspiece of the first portion, and at least one socket on the first end of the central portion;

said second connecting member includes at least one stud extending from the crosspiece of the second portion, and at least one socket on the second end of the central portion;

said first connecting member further comprising at least one end aperture on the first end of the central portion, wherein the end aperture extends through the socket thereon;

said second connecting member further comprising at least one end aperture on the second end of the central portion, wherein the end aperture extends through the socket thereon;

each of said studs of the first connecting member having at least one through hole extending therethrough;

each of said studs of the second connecting member having at least one through hole extending therethrough;

said means for releasably connecting the portions further include at least one pin;

said creeper further comprising assembled and disassembled configuration;

in said assembled configuration, said first and second portions are attached to said central portion wherein the at least one stud on said first portion is disposed in the at least one socket on the first end of the central portion with said at least one through hole in the at least one stud being aligned with the at least one end aperture on the first end of the central portion and said pin extending through the at least one end aperture and through hole; and the at least one stud on said second portion is disposed in the at least one socket on the second end of the central portion with said at least one through hole in the at least one stud being aligned with the at least one end aperture on the second end of the central portion and said pin extending through said at least one end aperture and through hole;

each of said casters comprises a mounting bracket, a wheel and a pivot bearing, wherein on each of said casters, the wheel is pivotally mounted on the mounting bracket and said mounting bracket is pivotally mounted to the distal end of a respective leg by one of said pivot bearings;

said platform is cushioned and includes first and second sections, wherein the first section has a thickness that is greater than a thickness of the second section and said platform is attached to the upper side of the frame in said assembled configuration; and said brake means for releasably engaging the support surface comprises a braking device having an engaged position and a disengaged position;

the braking device includes first and second brake shoes and actuating means for moving the brake shoes between the engaged and disengaged positions; each of said first and second brake shoes comprises an elongated member and brake pads disposed on a surface of the elongated member, wherein each of said brake pads comprises a resilient material;

said actuating means for moving the brake shoes between the engaged and disengaged positions comprise a linkage which includes first and second mounting rods, first and second levers, a tie rod, a handle and biasing means for holding the braking device in the disengaged position;

wherein said first and second mounting rods are pivotally mounted on the central portion;

wherein said first brake shoe is fixedly mounted to said first mounting rod, and said second brake shoe is fixedly mounted to said second mounting rod; said first lever is fixedly mounted to the one end of said first mounting rod and said second lever is fixedly mounted on the one end of said second mounting rod;

said handle is fixedly mounted to the end of said second mounting rod; said tie rod being pivotally attached at one end to said first lever and pivotally attached at an opposite end to said second lever;

said biasing means comprises a coil spring having a pair of ends, wherein one of said ends is attached to an end of the tie rod mounted on the first lever and the other end of said coil spring is attached to the first portion of said frame proximate the first lever; wherein said coil spring biases the braking device in the disengaged position;

wherein when said handle is rotated in a counterclockwise direction, the second mounting rod, second lever and second brake shoe are rotated; the first lever moves the tie rod which rotates the first lever, the first lever rotates the first mounting rod which in turn rotates the first brake shoe so that said braking device is in the engaged position with the brake pads lowered to engage the support surface, when the handle is rotated in a clockwise direction the first and second brake shoes are pivoted upwardly wherein said brake pads are raised away from the support surface and the braking device is in the disengaged position;

wherein when said braking device is in said engaged position said first and second brake shoes are lowered with the brake pads being directed away from the platform and said brake pads engage the support surface; and wherein when said brake system is in said disengaged position said first and second brake shoes are raised with the brake pads being directed away from the support surface and said creeper is allowed to roll freely.

* * * * *